US007946568B2

(12) United States Patent
Hayashi et al.

(10) Patent No.: US 7,946,568 B2
(45) Date of Patent: May 24, 2011

(54) SHEET PROCESSING APPARATUS AND IMAGE FORMING APPARATUS HAVING MOVABLE STOPPER WITH TWO CONVEYORS

(75) Inventors: Kenichi Hayashi, Abiko (JP); Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 168 days.

(21) Appl. No.: 12/257,557

(22) Filed: Oct. 24, 2008

(65) Prior Publication Data

US 2009/0121420 A1 May 14, 2009

(30) Foreign Application Priority Data

Nov. 8, 2007 (JP) ..... 2007-290521
Oct. 20, 2008 (JP) ..... 2008-269327

(51) Int. Cl.
*B65H 37/04* (2006.01)
*B65H 37/06* (2006.01)

(52) U.S. Cl. ..... 270/58.11; 270/58.13; 270/58.17; 270/58.19; 270/32; 270/37; 493/444; 493/445

(58) Field of Classification Search ..... 270/58.08, 270/58.11, 58.12, 58.13, 58.14, 58.16, 58.17, 270/58.18, 58.19, 32, 37, 45; 493/444, 445
See application file for complete search history.

(56) References Cited

U.S. PATENT DOCUMENTS 5,443,248 A 8/1995 Hayashi et al.
5,499,811 A 3/1996 Hayashi et al.
5,509,645 A * 4/1996 Shinno et al. ..... 270/58.17
5,678,818 A 10/1997 Hayashi et al.
5,735,515 A 4/1998 Hayashi et al.
5,746,424 A * 5/1998 Rutten et al. ..... 270/37
5,836,579 A 11/1998 Hayashi et al.
5,938,186 A 8/1999 Sato et al.
5,951,000 A 9/1999 Sato et al.
6,076,825 A 6/2000 Kato et al.
6,220,592 B1 4/2001 Watanabe et al.
6,276,677 B1 8/2001 Hommochi et al.
6,702,279 B2 3/2004 Adachi et al.
6,779,790 B2 * 8/2004 Kitahara ..... 270/58.12
6,817,605 B1 * 11/2004 Bohn ..... 270/37
6,910,686 B2 * 6/2005 Awano ..... 270/37
7,021,616 B2 4/2006 Mizuta et al.
7,328,892 B2 * 2/2008 Asami et al. ..... 270/37
7,331,573 B2 2/2008 Mizuta et al.
2007/0057427 A1 3/2007 Kamiya et al.
2008/0063451 A1 3/2008 Kamiya et al.

FOREIGN PATENT DOCUMENTS

JP 10-218475 A 8/1998
JP 11-193175 A 7/1999

* cited by examiner

*Primary Examiner* — Patrick Mackey
(74) *Attorney, Agent, or Firm* — Fitzpatrick, Cella, Harper & Scinto

(57) ABSTRACT

A saddle stitching portion which can bind the center portion in the conveying direction of a sheet bundle by a stapler and fold it by a pair of folding rollers and a pushout member, includes an end stopper which receives the downstream end of a sheet conveyed by a first conveying roller in a first receiving position on the downstream of the first conveying roller by a length not buckling the sheet on the downstream of the stapler or the downstream end of the sheet conveyed by a second conveying roller in a second receiving position on the downstream of the second conveying roller by the length on the further downstream, wherein the receiving position of the downstream end stopper is selected according to the length in the conveying direction of the sheet.

12 Claims, 12 Drawing Sheets

SHEET PROCESSING APPARATUS AND IMAGE FORMING APPARATUS HAVING MOVABLE STOPPER WITH TWO CONVEYORS

BACKGROUND OF THE INVENTION

1. Field of the Invention

The present invention relates to a sheet processing apparatus which selectively subjects sheets to binding and folding processes. More specifically, the present invention relates to a sheet processing apparatus used for an image forming apparatus such as a copying machine, a printer, or a multiple function processing machine having their functions.

2. Description of the Related Art

There have been proposed various sheet processing apparatuses which selectively subject a bundle of a plurality of sheets having an image formed thereon to binding and folding processes. As disclosed in Japanese Patent Application Laid-Open No. 11-193175, there has been known the sheet processing apparatus which makes a bundle of a plurality of sheets to bind its center portion and then folds the bundle into two along its binding portion to make a book bundle.

The sheet processing apparatus described in Japanese Patent Application Laid-Open No. 11-193175 conveys each sheet between a stapler dividedly arranged via a sheet conveying path and then aligns and stacks the sheets to make a sheet bundle. The sheet conveying operation is performed by conveying rollers arranged upstream and downstream of the stapler in the conveying direction of the sheet. The sheet conveyed by the conveying rollers is positioned by abutting its sheet downstream end on an end stopper. The position of the end stopper is set such that the center portion in the conveying direction of the sheet is in the binding position of the stapler for the next binding process. The sheet processing apparatus described in Japanese Patent Application Laid-Open No. 11-193175 moves the position of the end stopper in the conveying direction with reference to the positions of the stapler (or the binding positions) according to the size (or the length in the conveying direction) of the sheet. The aligned sheet bundle can be directly subjected to the binding process without being moved (or conveyed) for the binding process.

In the sheet processing apparatus described in Japanese Patent Application Laid-Open No. 11-193175, the conveying rollers on the upstream and downstream of the stapler need a conveying force which conveys a sheet into between the stapler to reliably abut its downstream end on the end stopper.

When the conveying force is excessively increased, the sheet is buckled between the conveying roller on the downstream and the end stopper, resulting in alignment failure. When the previous sheet is greatly buckled, the next sheet cannot be accepted, which can cause sheet jamming.

The sheet buckling is caused by excessive sheet warping between the conveying roller on the downstream and the end stopper. This can be easily caused as the distance between the conveying roller on the downstream and the end stopper is increased. A sheet which is longer in the conveying direction can be easily buckled.

To prevent the sheet buckling, it is considered a configuration which uniformly brings the end stopper close to the conveying roller on the downstream to a position where a sheet is not buckled regardless of the length in the conveying direction of the sheet. A sheet bundle need to be conveyed a long distance to the binding position for the next binding process depending on the length in the conveying direction of the sheet. Time required for processing the sheet can be increased.

SUMMARY OF THE INVENTION

To solve the above problems, a sheet processing apparatus of the present invention includes: a storing portion, inclined to be lower on a downstream portion than on an upstream portion in the conveying direction, which stores a conveyed sheet; a processing portion which processes a bundle of a plurality of the sheets stored in the storing portion in a processing position; a first conveying member which is provided on the downstream of the processing portion in a conveying direction of the sheet and conveys the sheet conveyed to the storing portion to the downstream in the conveying direction; a second conveying member which is provided on the downstream of the first conveying member in the conveying direction and conveys the sheet conveyed to the storing portion to the downstream in the conveying direction; and a receiving member which can be moved along the conveying direction of the sheet so that the receiving member receives the downstream end in the conveying direction of the sheet conveyed by the first conveying member in a first receiving position on the downstream of the first conveying member in the conveying direction or the downstream end in the conveying direction of the sheet conveyed by the second conveying member in a second receiving position on the downstream of the second conveying member in the conveying direction.

According to the present invention, the buckling of the sheet which is conveyed by the first conveying member or the second conveying member and is abutted on the receiving member can be prevented regardless of the length in the conveying direction of the sheet without increasing time required for processing the sheet.

Further features of the present invention will become apparent from the following description of exemplary embodiments with reference to the attached drawings.

DESCRIPTION OF THE EMBODIMENTS

An exemplary embodiment of the present invention will be illustratively described in detail with reference to the drawings. The size, material, shape, and their relative arrangement of the components described in the following embodiment are to be appropriately changed according to the configuration and various conditions of the apparatus to which the present invention is applied. Unless otherwise specified, the scope of the present invention is not limited to those.

Figure 1:
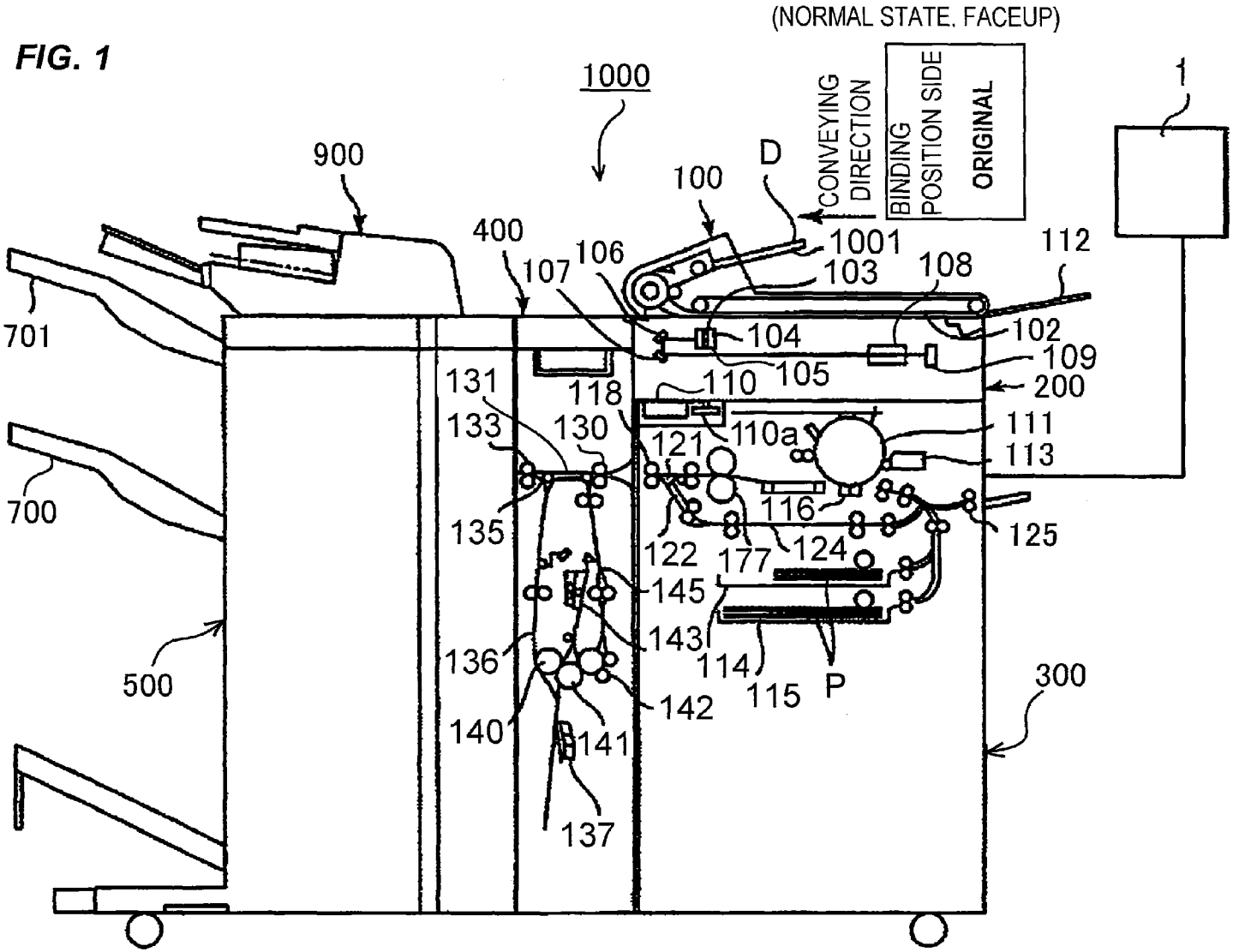
FIG. 1 is a cross-sectional view of an image forming apparatus having a sheet processing apparatus.
Figure 2:
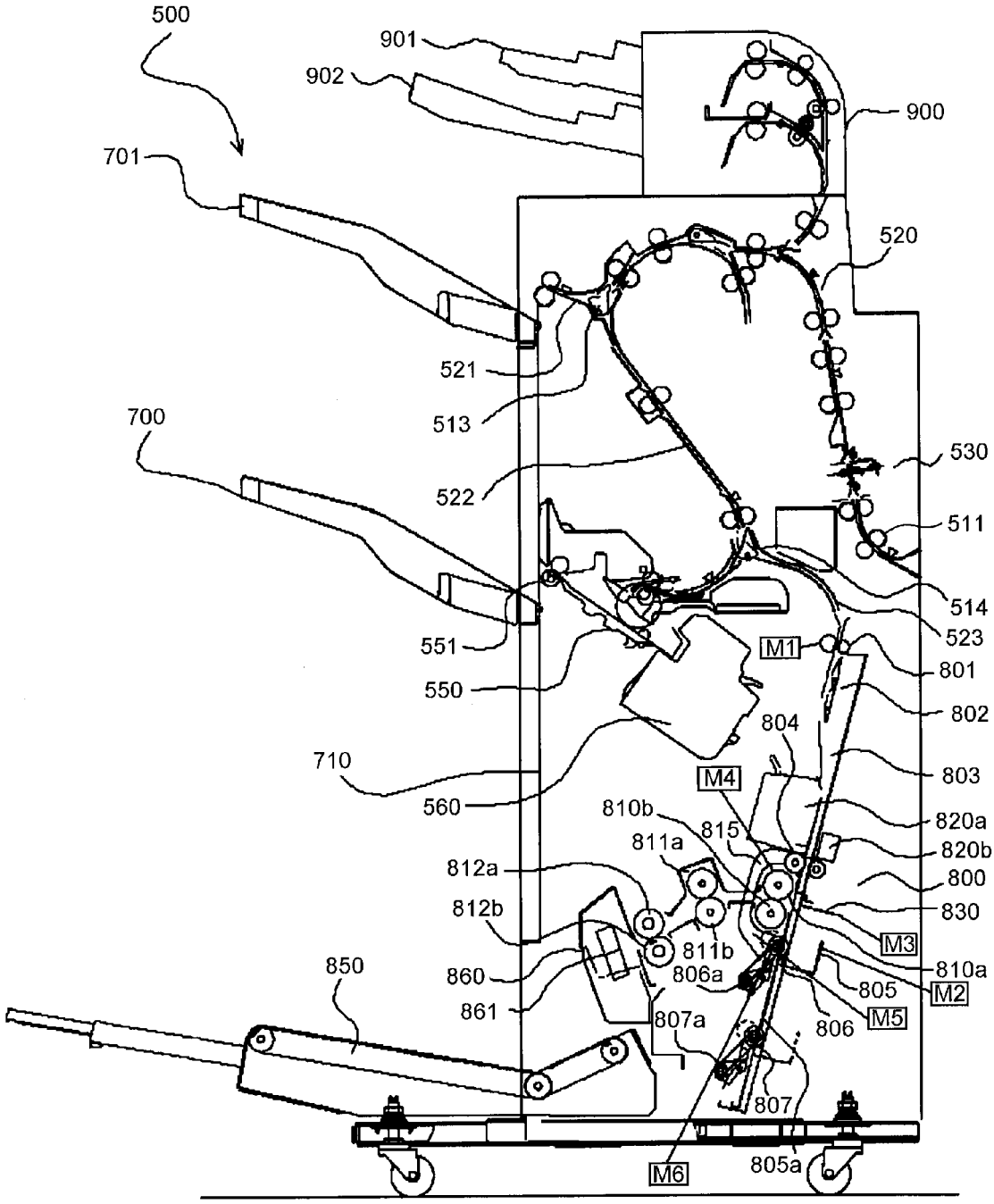
FIG. 2 is a cross-sectional view of the sheet processing apparatus.

An image forming apparatus having a sheet processing apparatus will be described using FIGS. 1 and 2. FIG. 1 is a schematic cross-sectional view illustrating the schematic configuration of the image forming apparatus having the sheet processing apparatus. Here, a copying machine is illustrated as the image forming apparatus. FIG. 2 is a schematic cross-sectional view illustrating the schematic configuration of the sheet processing apparatus.

As illustrated in FIG. 1, an image forming apparatus 1000 has an original feeding portion 100, an image reader portion 200, a printer portion 300, a folding process portion 400, a finisher 500, a saddle stitching portion 800, and an inserter 900. The folding process portion 400, the saddle stitching portion 800, and the inserter 900, as the sheet processing apparatus can be optional.

With reference to FIG. 1, originals are set on a tray 1001 of the original feeding portion 100 in normal state seen from the user and in faceup state (or in the state that the surface having an image faces up) and the binding position of each of the originals is at the left end of the original. Each of the originals set on the tray 1001 is sequentially conveyed by the original feeding portion 100 in the left direction (the arrow direction in the drawing) in page order, that is, in such a manner that the binding position is set to the downstream end. The original is conveyed on a platen glass 102 from left to right via a curved path and is then discharged onto a discharge tray 112. A scanner unit 104 is held in a predetermined position. The original passes on the scanner unit 104 from left to right so as to be read. The reading method is original scanning. When the original passes on the platen glass 102, the original is illuminated by a lamp 103 of the scanner unit 104. A reflection light from the original is guided to an image sensor 109 via mirrors 105, 106, and 107, and a lens 108.

The original conveyed by the original feeding portion 100 can also be read by stopping it once on the platen glass 102 to move the scanner unit 104 from left to right in that state. The reading method is original fixation reading. When the original is read without using the original feeding portion 100, the user lifts the original feeding portion 100 to set the original on the platen glass 102. In this case, the original fixation reading is performed.

The image data of the original read by the image sensor 109 is subjected to a predetermined imaging process and is then conveyed to an exposure controlling portion 110. The exposure controlling portion 110 outputs a laser beam according to an image signal. The laser beam illuminates a photosensitive drum 111 while being scanned by a polygon mirror 110*a*. An electrostatic latent image according to the scanned laser beam is formed on the photosensitive drum 111.

The electrostatic latent image formed on the photosensitive drum 111 is developed by a development device 113 which configures an image forming portion together with the photosensitive drum 111 and is then made visible as a toner image. A recording sheet is conveyed to a transfer portion 116 from any one of cassettes 114 and 115, a manual feeding portion 125, and a duplex conveying path 124. The visible toner image is transferred onto the sheet by the transfer portion 116. The sheet onto which the toner image is transferred is subjected to a fixing process by a fixing portion 177.

The sheet which has passed through the fixing portion 177 is guided once to a path 122 by a switching member 121. The trailing end of the sheet passes through the switching member 121. The sheet is switched back and is then conveyed to a discharge roller 118 by the switching member 121. The sheet is discharged from the printer portion 300 by the discharge roller 118. The sheet can be discharged from the printer portion 300 in the state that the surface having the toner image faces down. This will be called inverted discharge.

As described above, each of the facedown sheets is discharged to the outside of the apparatus and is then sequentially subjected to an image forming process in page order. The pages can be ordered when the image forming process is performed using the original feeding portion 100 or the image forming process is performed to image data from the computer.

When a hard sheet such as an OHP sheet conveyed from the manual feeding portion 125 is subjected to the image forming process, the sheet is discharged from the printer portion 300 by the discharge roller 118 without guiding the sheet to the path 122 in the state that the surface having the toner image faces up.

When a duplex sheet is subjected to the image forming process, the sheet is guided directly from the fixing portion 177 to the discharge roller 118. The sheet is switched back immediately after the trailing end of the sheet has passed through the switching member 121, and is then guided to the duplex conveying path 124 by the switching member 121.

The configuration of the folding process portion 400 and the finisher 500 will be described with reference to FIGS. 1 and 2.

The folding process portion 400 has a conveying path 131 which introduces the sheet discharged from the printer portion 300 to guide it to the finisher 500. A pair of conveying rollers 130 and a pair of discharge rollers 133 are provided on the conveying path 131. A switching member 135 provided near the pair of discharge rollers 133 guides the sheet conveyed by the pair of conveying rollers 130 to a folding path 136 or the finisher 500.

When the sheet is folded, the switching member 135 is switched to the folding path 136 to guide the sheet to the folding path 136. The sheet guided to the folding path 136 is conveyed to a folding roller 140 and is then folded in Z shape. When the sheet is not folded, the switching member 135 is switched to the finisher 500 to directly convey the sheet discharged from the printer portion 300 thereinto via the conveying path 131.

A loop formed by abutting the downstream end of the sheet conveyed on the folding path 136 on a stopper 137 is folded by the folding roller 140 and a folding roller 141. A loop formed by abutting the folding portion on an upper stopper 143 is folded by the folding roller 141 and a folding roller 142 to fold the sheet in Z shape. The sheet folded in Z shape is conveyed to the conveying path 131 via a conveying path 145 and is then discharged to the finisher 500 provided on the downstream by the pair of discharge rollers 133. The folding process operation of the folding process portion 400 is selectively performed.

The finisher 500 takes in the sheet from the printer portion 300 conveyed via the folding process portion 400. The finisher 500 selectively performs a process which aligns a plurality of taken-in sheets to bind them into a sheet bundle, a stapling process (or binding process) which staples the trailing end of the sheet bundle, a sort process, and a non-sort process.

As illustrated in FIG. 2, the finisher 500 has a conveying path 520 which takes the sheet conveyed via the folding process portion 400 into the apparatus. The conveying path 520 has a plurality of pairs of conveying rollers.

A punch unit 530 is provided midway the conveying path 520. The punch unit 530 is operated as needed and punches the trailing end of the sheet conveyed.

A switching member 513 is provided at the termination of the conveying path 520. The switching member 513 switches between an upper discharge path 521 and a lower discharge path 522 connected to the downstream. The upper discharge path 521 discharges the sheet onto an upper stack tray 701. The lower discharge path 522 discharges the sheet onto a processing tray 550. The sheet discharged onto the processing tray 550 is sequentially aligned so as to be stored in a bundle. The sort process and the stapling process are selectively performed according to setting from an operation portion 1. The sheet is discharged onto a stack tray 700 and the stack tray 701 by a pair of bundle discharge rollers 551.

The stapling process is performed by a stapler 560. The stapler 560 can be moved in the width direction orthogonal to the conveying direction of the sheet and can staple the sheet in an arbitrary portion. The stack trays 700 and 701 can be moved upward and downward. The upper stack tray 701 can receive the sheet from the upper discharge path 521 and the processing tray 550. The lower stack tray 700 can receive the sheet from the processing tray 550. The stack trays 700 and 701 can stack a large amount of sheets. The trailing end of the stacked sheet is regulated and aligned by a trailing end guide 710 extended upward and downward.

A switching member 514 is provided midway the lower discharge path 522 and guides the sheet to the processing tray 550 or a saddle discharge path 523. The sheet guided to the saddle discharge path 523 by the switching member 514 is conveyed to the saddle stitching portion 800.

The configuration of the saddle stitching portion 800 as the sheet processing apparatus will be described.

The sheet conveyed to the saddle stitching portion 800 is conveyed to a pair of saddle inlet rollers 801. The conveying port is selected by a switching member 802 operated by a solenoid according to size. The sheet is conveyed into a storing guide 803 as the storing portion of the saddle stitching portion 800. The conveyed sheet is continued to be conveyed by a sliding roller 804 and is then conveyed to a first conveying roller 806 and a second conveying roller 807 provided together downstream. The sliding roller 804 is a roller having sliding properties. The first conveying roller 806 and the second conveying roller 807 have sliding properties like the sliding roller 804. The first conveying roller 806 is a first conveying member which is provided on the downstream of a later-described stapler 820 in the conveying direction of the sheet and conveys the sheet stored in the storing guide 803 to the downstream. The second conveying roller 807 is a second conveying member which is provided on the downstream of the first conveying roller 806 in the conveying direction of the sheet and conveys the sheet stored in the storing guide 803*b* to the downstream. The first conveying roller 806 and the second conveying roller 807 can be moved to the abutment position (or the solid line position) which is abutted on the sheet and the retract position (or the dashed line position) away from the sheet about fulcrum shafts 806*a* and 807*a* by the solenoid (not illustrated), respectively. The surfaces of the sliding roller 804, the first conveying roller 806, and the second conveying roller 807 are formed of sponge, have sliding properties, and reliably convey the sheet to a later-described end stopper to correct inclined conveying.

The pair of saddle inlet rollers 801 and the sliding roller 804 are driven by a motor M1. The first conveying roller 806 and the second conveying roller 807 are driven by a motor M6.

The sheet conveyed by the first conveying roller 806 or the second conveying roller 807 is conveyed until the downstream end is abutted on an end stopper 805 moved to a first receiving position or a second receiving position according to the length in the conveying direction. The end stopper 805 can be moved in the conveying direction of the sheet along the sheet guide surface, inclined to be lower on a downstream portion than on an upstream portion in the conveying direction, of the storing guide 803. The end stopper 805 is a receiving member which receives the downstream end of the sheet conveyed by the first conveying roller 806 in the first receiving position (or the solid line position of FIG. 2) or the downstream end of the sheet conveyed by the second conveying roller 807 in the second receiving position (or the dashed line position of FIG. 2). The first receiving position and the second receiving position of the end stopper 805 will be described later in detail.

The end stopper 805 has a regulating surface 805*a* (see FIG. 3) protruded from the storing guide 803 and can be moved along the conveying direction of the sheet upon reception of a driving force from a motor M2.

The end stopper 805 receives the sheet in the first receiving position or the second receiving position having a distance in a predetermined range on the downstream of the first conveying roller 806 or the second conveying roller 807. The first receiving position is the solid line position indicated in FIG. 2 and is a receiving position on the downstream of the first conveying roller 806 by a predetermined distance so as not to buckle the sheet. The second receiving position is the dashed line position indicated in FIG. 2 and a receiving position on the downstream of the second conveying roller 807 by the distance. The predetermined range is a range in which when the sheet is abutted on the regulating surface 805*a* and then receives the conveying force of the conveying roller, the sheet is not buckled. The degree of easily buckling the sheet is in proportion to the length in the conveying direction of the sheet. The length between the conveying roller and the receiving position of the end stopper 805 is preferably short in the predetermined range. The predetermined range is set to 15 to 30 mm, which is different depending on the rigidity (basis weight) of the sheet and the conveying force of the conveying roller. The value is determined by an experiment. The present invention is not limited to the value. When the previously stored sheet is buckled, it blocks the conveying path of the next stored sheet, causing sheet jamming. The predetermined range is set so as not to cause sheet jamming.

Figure 3:
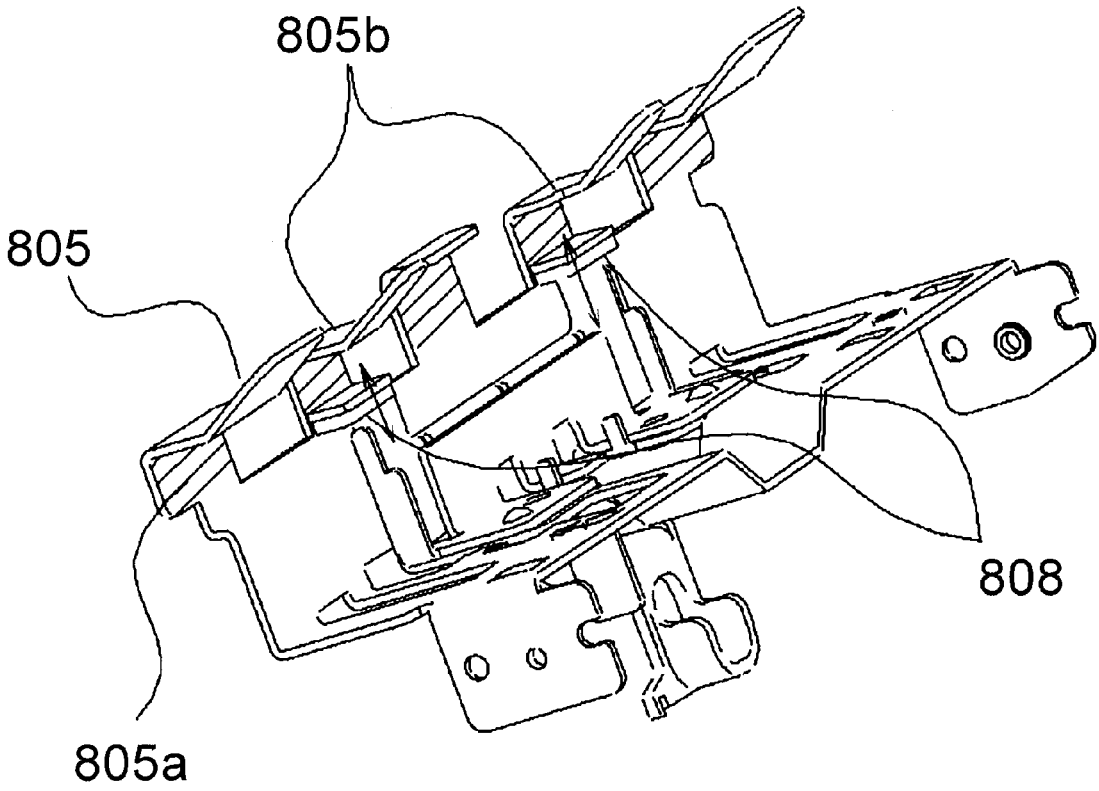
FIG. 3 is a perspective view of an end stopper.

As illustrated in FIG. 3, the end stopper 805 has a guide surface 805*b* which is bent from the regulating surface 805*a* so as to be opposite the guide surface of the storing guide 803. The end stopper 805 has a holding member 808 which is moved in the arrow direction along the regulating surface 805*a* by the solenoid (not illustrated). The holding member 808 cooperates with the guide surface 805*b* to nip and hold the sheet bundle stored in the storing guide 803 and abutted on the end stopper 805. The end stopper 805 which cooperates with the holding member 808 to nip the sheet bundle functions as a bundle conveying portion. The configuration of the apparatus can be simple. The stored sheet can be conveyed to the processing position (or the binding position or folding position) without being disturbed.

The stapler 820 which are provided midway the storing guide 803 so as to be on the opposite sides of the storing guide 803. The stapler 820 is a binding portion which binds the center portion in the conveying direction of the bundle of the plurality of sheets stored in the storing guide 803. The stapler 820 is divided into a driver 820*a* which protrudes a staple and an anvil 820*b* which bends the protruded staple, and staples the center portion in the conveying direction of the bundle of the stored sheets.

The short moving distance from the receiving position of the downstream end of the sheet received by the end stopper 805 to the stapling position (or the folding position) can shorten the processing time or is preferable from the viewpoint of the stability of bundle conveying. In this embodiment, a length from the downstream end of the sheet to a position to be processed on the sheet is a length L/2 of half of a length L in the conveying direction of the sheet to be conveyed. A later-described controlling portion judges which of a first distance (length) L1 from the stapling position to the regulating surface in the first receiving position and a second distance (length) L2 from the stapling position to the regulating surface in the second receiving position is closer to a length L/2 of half of a length L in the conveying direction of the sheet conveyed. The receiving position of the end stopper 805 of which a length to the position to be processed is closer to the length L/2 of the sheet is selected.

A pair of folding rollers 810*a* and 810*b* and a pushout member 830 are provided on the downstream of the stapler 820 so as to be on the opposite sides of the storing guide 803. The pair of folding rollers 810*a* and 810*b* and the pushout member 830 are a folding portion which folds the sheet bundle stored in the storing guide 803 into two along the center portion in the conveying direction. The pushout member 830 has a home position retracted from the storing guide 803 and is protruded toward the center portion in the conveying direction of the sheet bundle stored in the storing guide 803 by the driving force of a motor M3. The sheet bundle is pushed into the nip between the pair of folding rollers 810*a* and 810*b* and is then folded into two along the center portion. The pushout member 830 pushes out the sheet bundle and then returns to the home position. A pressure F1 which is enough to fold the sheet bundle is provided by a spring (not illustrated) between the pair of folding rollers 810. The folded sheet bundle is discharged onto a folded bundle discharge tray 850 via a pair of first fold conveying rollers 811*a* and 811*b* and a pair of second fold conveying rollers 812*a* and 812*b*. Pressures F2 and F3 which are enough to convey and stop the folded sheet bundle are provided to the pair of first fold conveying rollers 811 and the pair of second fold conveying rollers 812, respectively.

A conveying guide 813 (see FIG. 10) is a conveying guide which guides the sheet between the pair of folding rollers 810 and the pair of first fold conveying rollers 811. A conveying guide 814 (see FIG. 10) is a conveying guide which guides the sheet between the pair of first fold conveying rollers 811 and the pair of second fold conveying rollers 812. The pair of folding rollers 810, the pair of first fold conveying rollers 811, and the pair of second fold conveying rollers 812 are rotated at an equal speed by the same motor M4.

When the sheet bundle is folded without performing the binding process, the sheet bundle is moved such that the center portion in the conveying direction of the sheet bundle stored in the storing guide 803 is in the nip position between the pair of folding rollers 810*a* and 810*b*. When the sheet bundle bound by the stapler 820 is folded, the sheet bundle in the stapling position is moved after completion of the stapling process such that the stapling position (or the center portion in the conveying direction) of the sheet bundle is in the nip position between the pair of folding rollers 810. The sheet bundle can be folded at the stapling position.

The sheet bundle is moved from the sheet storing position (or each of the receiving positions) to the stapling position and from the stapling position to the folding position by moving the end stopper 805 in the conveying direction of the sheet. The sheet bundle is nipped between the guide surface 805*b* of the end stopper 805 and the holding member 808. In this state, the end stopper 805 is lowered or raised by the motor M2 to convey the sheet bundle. The holding member 808 can cooperate with the guide surface 805*b* to generate a sufficient nipping pressure without disturbing alignment of the sheet bundle during movement of the bundle.

A pair of aligning plates 815 each having a surface protruded to the storing guide 803 while moving around the outer circumferential surfaces of the pair of folding rollers 810*a* and 810*b* are provided in the positions of the pair of folding rollers 810*a* and 810*b*. The pair of aligning plates 815 are moved in the width direction orthogonal to the conveying direction of the sheet upon driving of a motor M5 to align (or position) the sheet stored in the storing guide 803 in the width direction.

A fold press unit 860 which presses the fold of the sheet bundle folded into two is provided on the downstream of the pair of second fold conveying rollers 812. The fold press unit 860 has a press holder which supports a pair of press rollers 861 and is moved in the fold direction (or the width direction orthogonal to the conveying direction) of the sheet bundle in the state that the pair of press rollers 861 nip the fold of the sheet bundle. The fold of the sheet bundle is pressed. The folded bundle discharge tray 850 stacks the saddle stitched books together.

The configuration of the inserter 900 will be described. The inserter 900 is provided in the upper portion of the finisher 500. The inserter 900 inserts a sheet (or an insert sheet) different from an ordinary sheet, as the first sheet, the last sheet, or a sheet between them. The inserter 900 inserts the insert sheet or a cover sheet between sheets having an image formed thereon by the printer portion 300.

The inserter 900 feeds the sheet set to insert trays 901 and 902 by the user to any one of the stack trays 701 and 700 and the folded bundle discharge tray 850 not via the printer portion 300. Each of the sheets of the bundle stacked onto the insert trays 901 and 902 is sequentially separated so as to join the conveying path 520 with desired timing.

Figure 4:
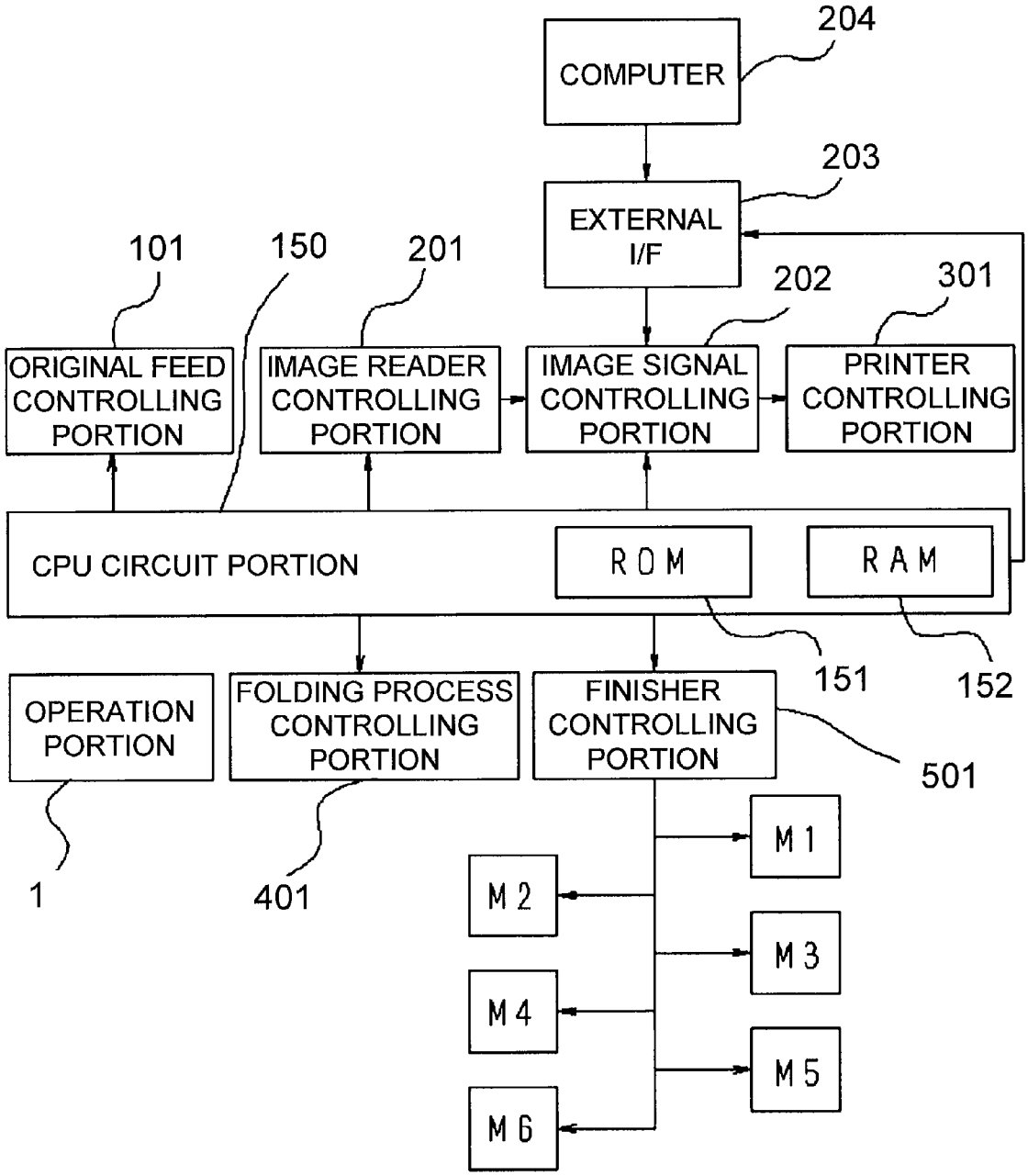
FIG. 4 is a block diagram illustrating the configuration of a control system of the image forming apparatus.

Here, the control system of the image forming apparatus 1000 will be described using FIG. 4. FIG. 4 is a block diagram illustrating the configuration of the control system of the image forming apparatus 1000. A CPU circuit portion 150 is provided in the printer portion 300 and has a CPU (not illustrated), a ROM 151, and a RAM 152. The CPU circuit portion 150 controls an original feed controlling portion 101, an image reader controlling portion 201, an image signal controlling portion 202, a printer controlling portion 301, a folding process controlling portion 401, a finisher controlling portion 501, and an external I/F (external interface) 203 according to setting of a control program stored in the ROM 151 and the operation portion 1. The original feed controlling portion 101 controls the original feeding portion 100. The image reader controlling portion 201 controls the image reader portion 200. The printer controlling portion 301 controls the printer portion 300. The folding process controlling portion 401 is mounted on the folding process portion 400. The finisher controlling portion 501 is mounted on the finisher 500 to control the finisher 500, the saddle stitching portion 800, and the inserter 900. Specifically, the driving of the motors M1 to M6 of the saddle stitching portion 800 is controlled by the finisher controlling portion 501. The operation portion 1 has a plurality of keys which set various functions about image formation and a displaying portion which displays a set state. The operation portion 1 outputs a key signal corresponding to operation of each of the keys by the user to the CPU circuit portion 150, and displays the corresponding information based on a signal from the CPU circuit portion 150.

The RAM 152 is used as an area which temporarily holds control data and an operating area of computation with control. The external I/F 203 is an interface between the image forming apparatus 1000 and an external computer 204, and develops print data from the computer 204 to a bitmap image to output it as image data to the image signal controlling portion 202. The image of the original read by the image sensor 109 is outputted from the image reader controlling portion 201 to the image signal controlling portion 202. The printer controlling portion 301 outputs the image data from the image signal controlling portion 202 to the exposure controlling portion 110.

In this embodiment, the configuration in which the finisher controlling portion 501 is mounted on the finisher 500 will be described. The finisher controlling portion 501 may be provided in the printer portion 300 so as to be integral with the CPU circuit portion 150 to control the finisher 500 from the printer portion 300.

Figure 11:
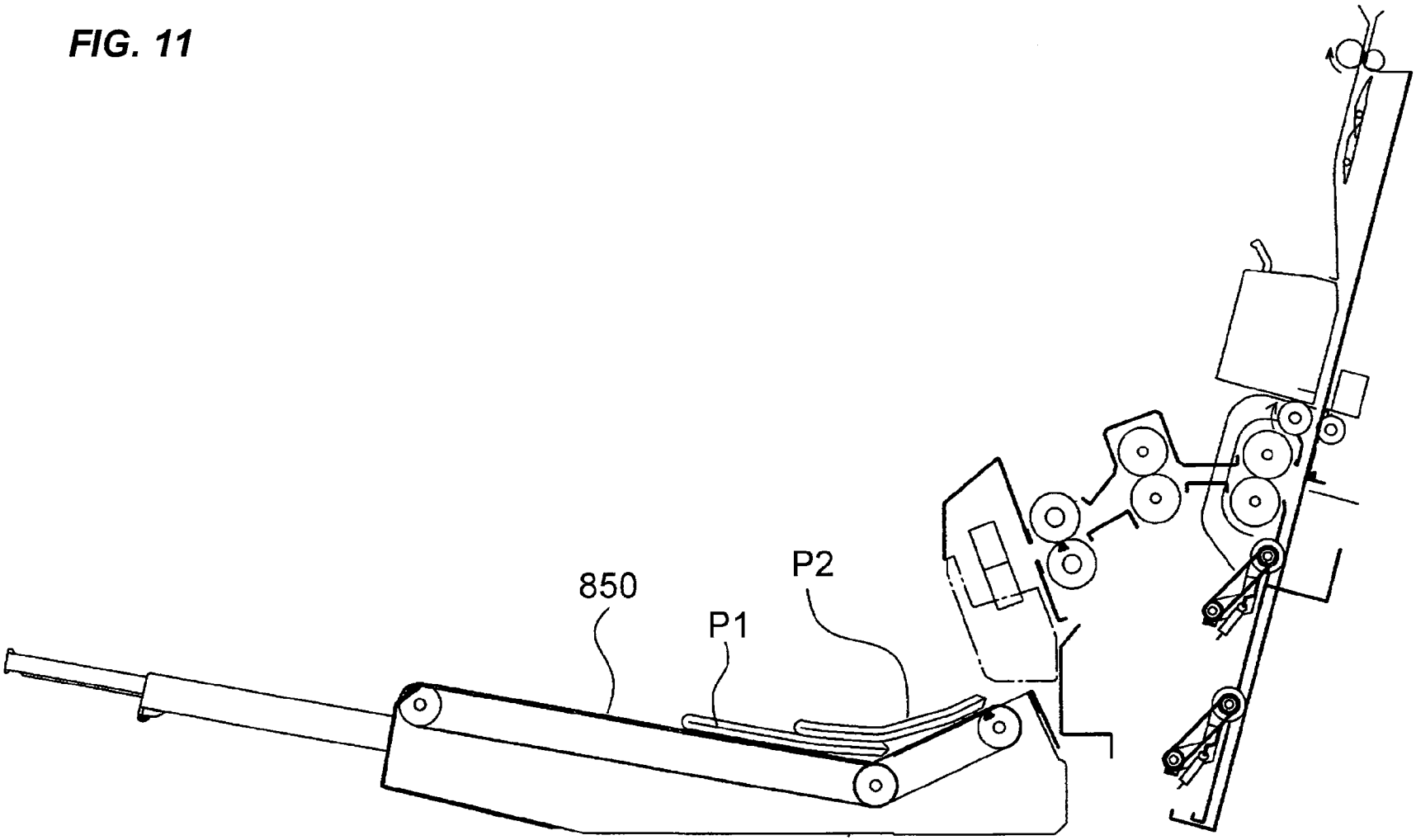
FIG. 11 is a cross-sectional view illustrating the operation of the saddle stitching portion.
Figure 12:
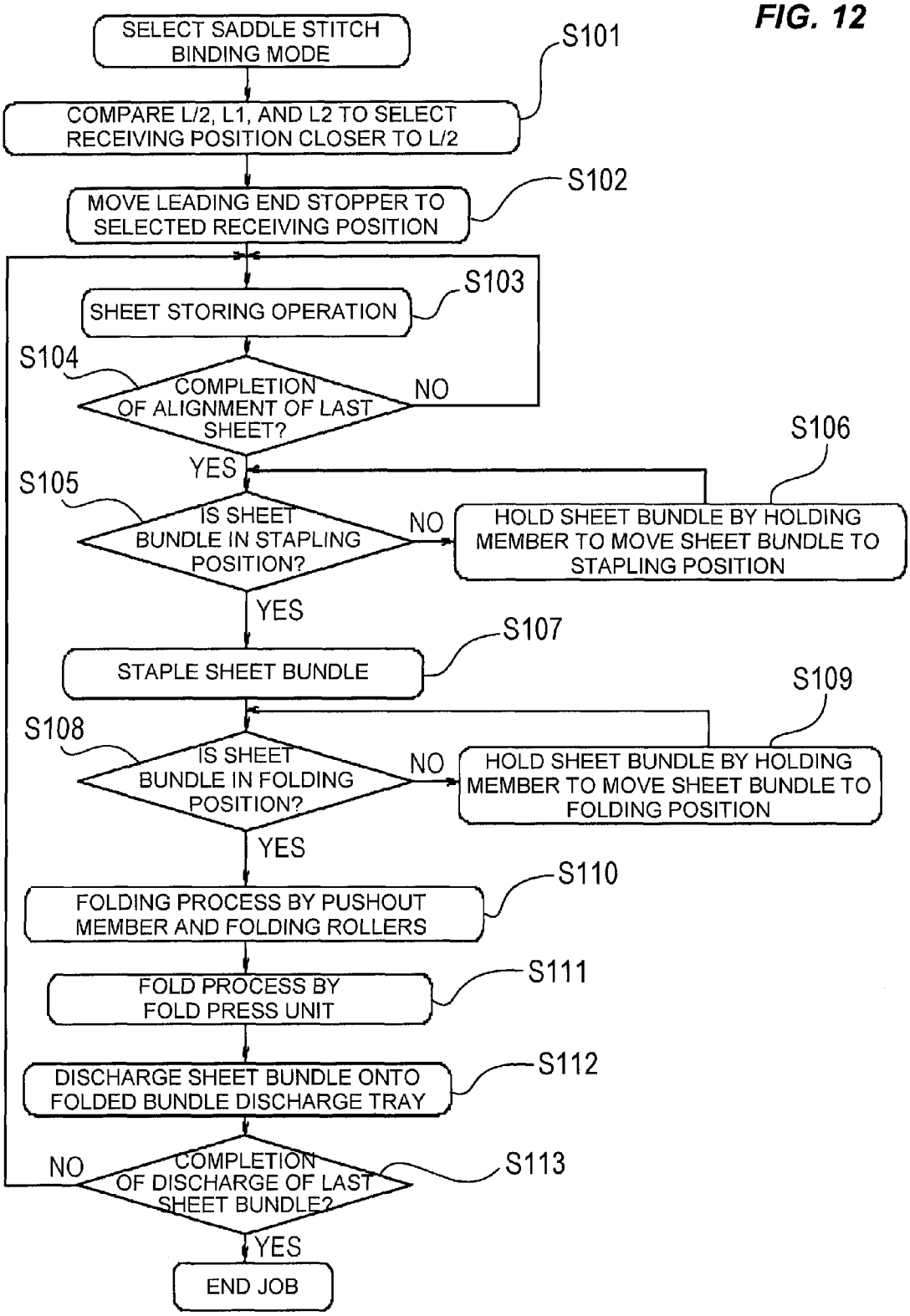
FIG. 12 is a flowchart illustrating an operation in a saddle stitching mode.

The operation of the saddle stitching portion 800 of the above configuration will be described together with the flow of sheets using FIGS. 5 to 12. FIGS. 5 to 11 are cross-sectional views illustrating the operation of the saddle stitching portion. FIG. 12 is a flowchart illustrating the operation of the saddle stitching portion.

When a saddle stitching mode is set by the operator, a sheet P having an image formed thereon is sequentially discharged from the discharge roller 118 of the printer portion 300. The sheet P passes through the folding process portion 400 so as to be conveyed to a pair of inlet rollers 511 and then passes through the conveying path 520 to enter the lower discharge path 522. The sheet P is guided to the saddle discharge path 523 by the switching member 514 midway the lower discharge path 522.

Before the sheet P is conveyed into the saddle stitching portion 800, the receiving position of the end stopper 805 is selected according to the length L in the conveying direction of the sheet. The end stopper 805 is moved to the first receiving position or the second receiving position (steps S101 and S102). As described above, the controlling portion judges which of the length L1 from the stapling position to the regulating surface 805*a* in the first receiving position and the length L2 from the stapling position to the regulating surface 805*a* in the second receiving position is closer to the length L/2 of half of the length L in the conveying direction of the sheet P. The receiving position of the end stopper 805 closer to the length L/2 of the sheet is selected. When the length L/2 of half of the length L in the conveying direction of the sheet is shorter than the length L1 from the stapling position of the stapler 820 to the first receiving position, the first receiving position is selected. When the length L/2 of half of the length L in the conveying direction of the sheet is longer than the length L1 from the stapling position of the stapler 820 to the first receiving position, the receiving position closer to the length L/2 of the sheet is selected.

The end stopper in which the first receiving position is selected is set in the predetermined range according to the length in the conveying direction of the sheet. The end stopper in which the second receiving position is selected is set in the predetermined range according to the length in the conveying direction of the sheet. The distance from the first conveying roller 806 to the first receiving position and the distance from the second conveying roller 807 to the second receiving position are set in the predetermined range according to the length in the conveying direction of the sheet. The predetermined range is a range for fine adjustment of the difference between the lengths in the conveying direction of the sheets in which either of the receiving positions is selected. For instance, the predetermined range is a range for fine adjustment of the difference between the lengths in the conveying direction of an A4 size sheet and a letter size sheet when the first receiving position is selected.

Figure 5:
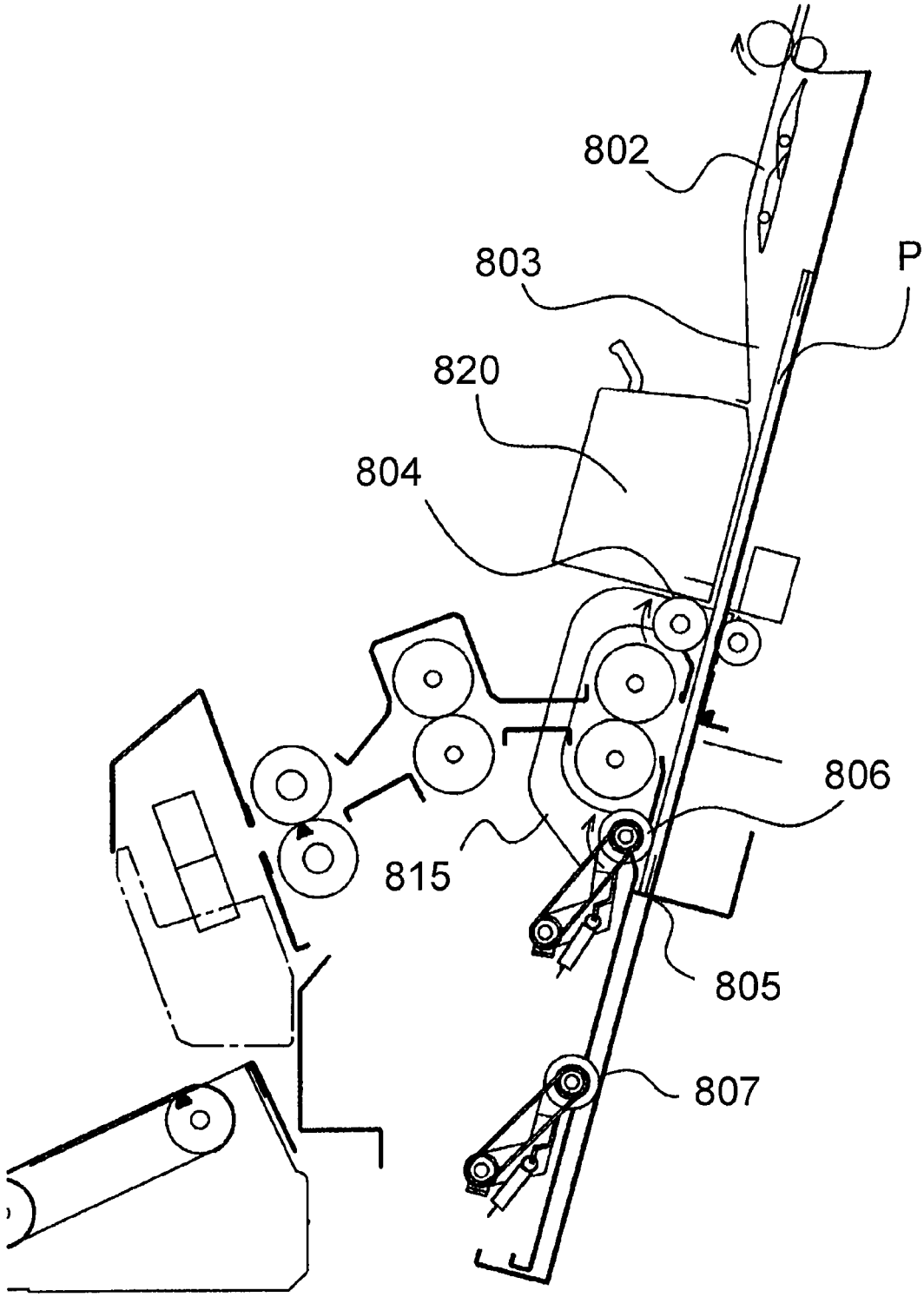
FIG. 5 is a cross-sectional view illustrating the operation of a saddle stitching portion.

FIG. 5 illustrates the state that the first receiving position is selected. The sheet P guided to the saddle discharge path 523 is guided by the switching member 802 according to sheet size so as to be discharged to the storing guide 803. The sheet P receives the conveying force of the sliding roller 804 and the first conveying roller 806. The sheet P is abutted on the regulating surface 805*a* (see FIG. 3) of the end stopper 805 stopped in the first receiving position and is then stopped.

Figure 6:
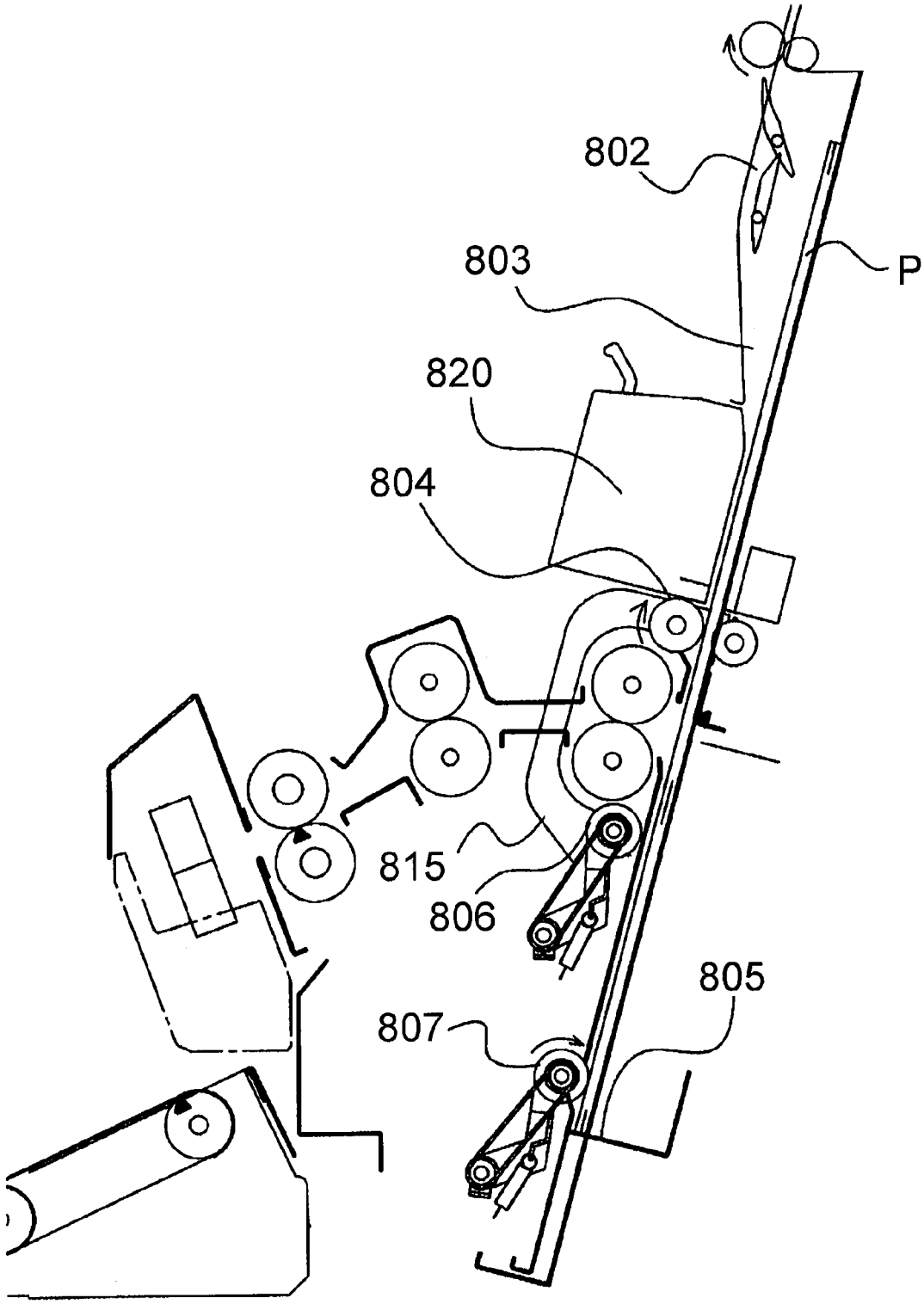
FIG. 6 is a cross-sectional view illustrating the operation of the saddle stitching portion.

FIG. 6 illustrates the state that the second receiving position is selected. The sheet P guided to the saddle discharge path 523 is guided by the switching member 802 according to sheet size so as to be discharged to the storing guide 803. The sheet P receives the conveying force of the sliding roller 804 and the second conveying roller 807. The sheet P is abutted on the regulating surface 805*a* (see FIG. 3) of the end stopper 805 stopped in the second receiving position and is then stopped. The first conveying roller 806 is moved in the position away from the sheet P by the solenoid. The second conveying roller 807 may be moved in the position away from the sheet P by the solenoid when the first receiving position is selected.

In either case, as described above, the distance between the regulating surface 805*a* of the end stopper 805 and the conveying roller corresponding to the receiving position of the end stopper 805 is determined in the range so as not to buckle the sheet P received.

The downstream end in the conveying direction of the sheet P is abutted on the regulating surface 805*a* of the end stopper 805. The conveying rollers 806 and 807 can be slid and rotated without buckling the sheet upon reception of the conveying force of the conveying rollers 806 and 807. The downstream end of the sheet is abutted on the end stopper 805. The sheet is aligned in the conveying direction and is then stacked.

The plurality of sheet receiving positions are provided to shorten time required for processing the sheet, reduce the space of the apparatus, and increase the quality of the sheet bundle. The plurality of conveying rollers are disposed according to the receiving positions.

In the case where only the first receiving position of the sheet is provided, the storing guide 803*d* needs to be extended upward to store the sheet in the conveying direction without buckling it. Along with it, the apparatus becomes larger and the corresponding range of the switching member 802 switched according to sheet size is increased. The moving distance from the storing position to the stapling position is increased depending on sheet size. Time required for processing the sheet bundle can be increased. Shifting during moving of the bundle can be easily caused.

In the case where only the second receiving position of the sheet is provided, the storing guide 803 needs to be extended downward to store the sheet in the conveying direction. As described above, the apparatus becomes larger and the corresponding range of the switching member 802 switched according to sheet size is increased. The moving distance from the storing position to the stapling position is increased depending on sheet size. Time required for processing the sheet bundle can be increased. Shifting during moving of the bundle can be easily caused.

As described above, the plurality of sheet receiving positions are provided, the plurality of conveying rollers are provided according to the receiving positions, and the receiving position is selected according to sheet size. The storing guide 803 can be minimized. The moving distance to the stapling position can be shortened. Time required for processing the sheet bundle can be shortened, the space of the apparatus can be reduced, and the quality of the sheet bundle can be increased.

The following operation is the same regardless of the receiving positions. The case of selecting the first receiving position will be illustratively described.

As described above, after the receiving position of the end stopper 805 has been selected to move the end stopper 805, the sheet storing operation to the saddle stitching portion 800 is started (step S103). As described above, the downstream end of the sheet is abutted on the end stopper 805 moved to the receiving position to align the sheet in the conveying direction. The sheet is nipped between the pair of aligning plates 815 on standby in the non-interfering position at sheet storing and is aligned. The sheet is aligned in the width direction orthogonal to the conveying direction. The sheet storing and aligning operation is performed each time one of the sheets P is discharged to the storing guide 803.

Figure 7:
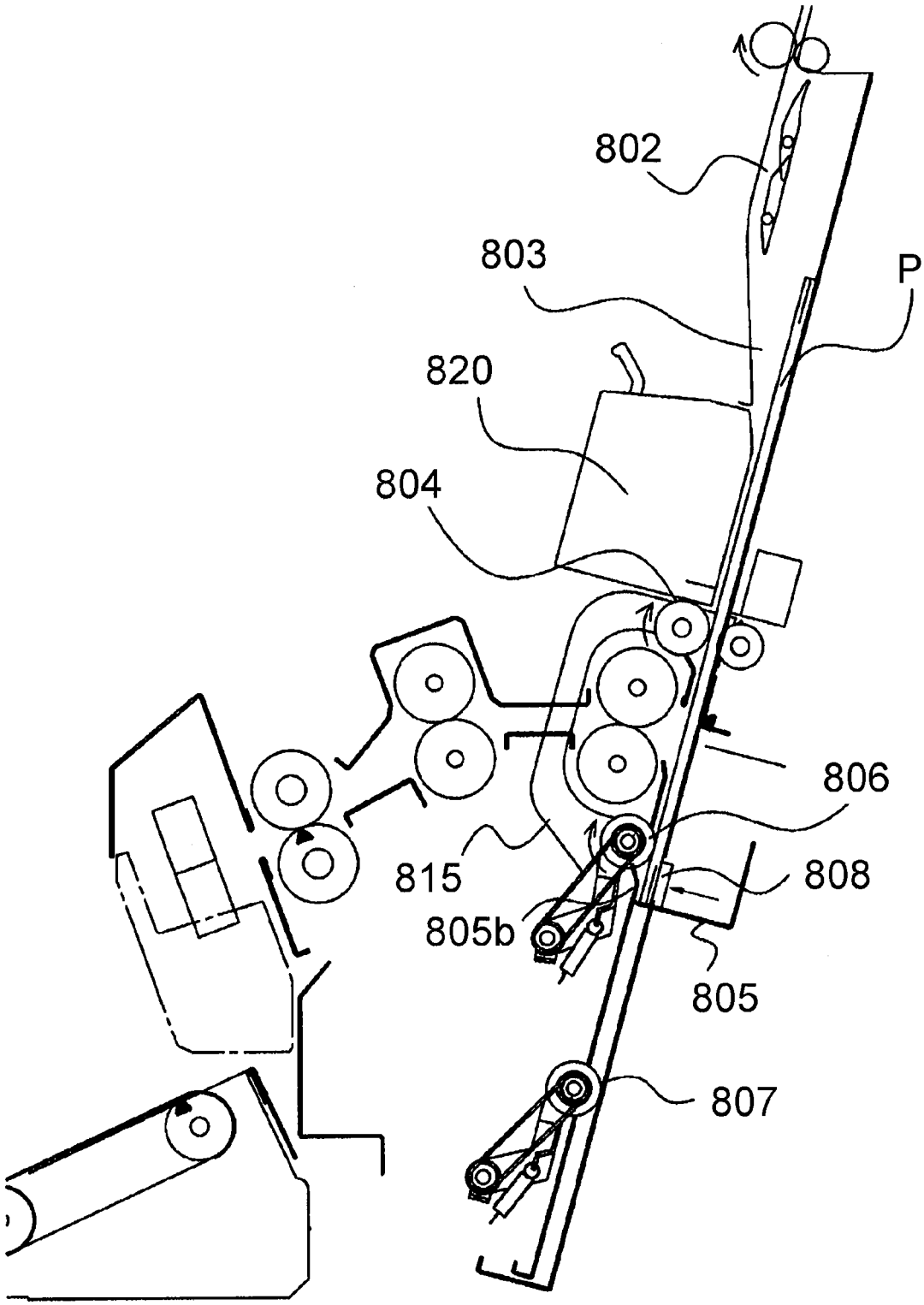
FIG. 7 is a cross-sectional view illustrating the operation of the saddle stitching portion.

As illustrated in FIG. 7, when alignment of the last sheet is completed (step S104), the holding member 808 which is on standby outside the sheet conveying path is moved in the arrow direction by the solenoid and cooperates with the guide surface 805*b* of the end stopper 805 to nip a stored sheet bundle P1. When the center portion in the conveying direction of the stored sheet bundle has already been located in the stapling position, the stapling process of the stapler 820 is directly performed (step S105). When it is not in the stapling position, the end stopper 805 which nips the sheet bundle is moved by the motor M2 to move the sheet bundle P1 to the stapling position (step S106). The sliding roller 804 and the first conveying roller 806 are rotated in the bundle moving direction at a speed equal to the moving speed of the sheet bundle of the end stopper 805.

Figure 8:
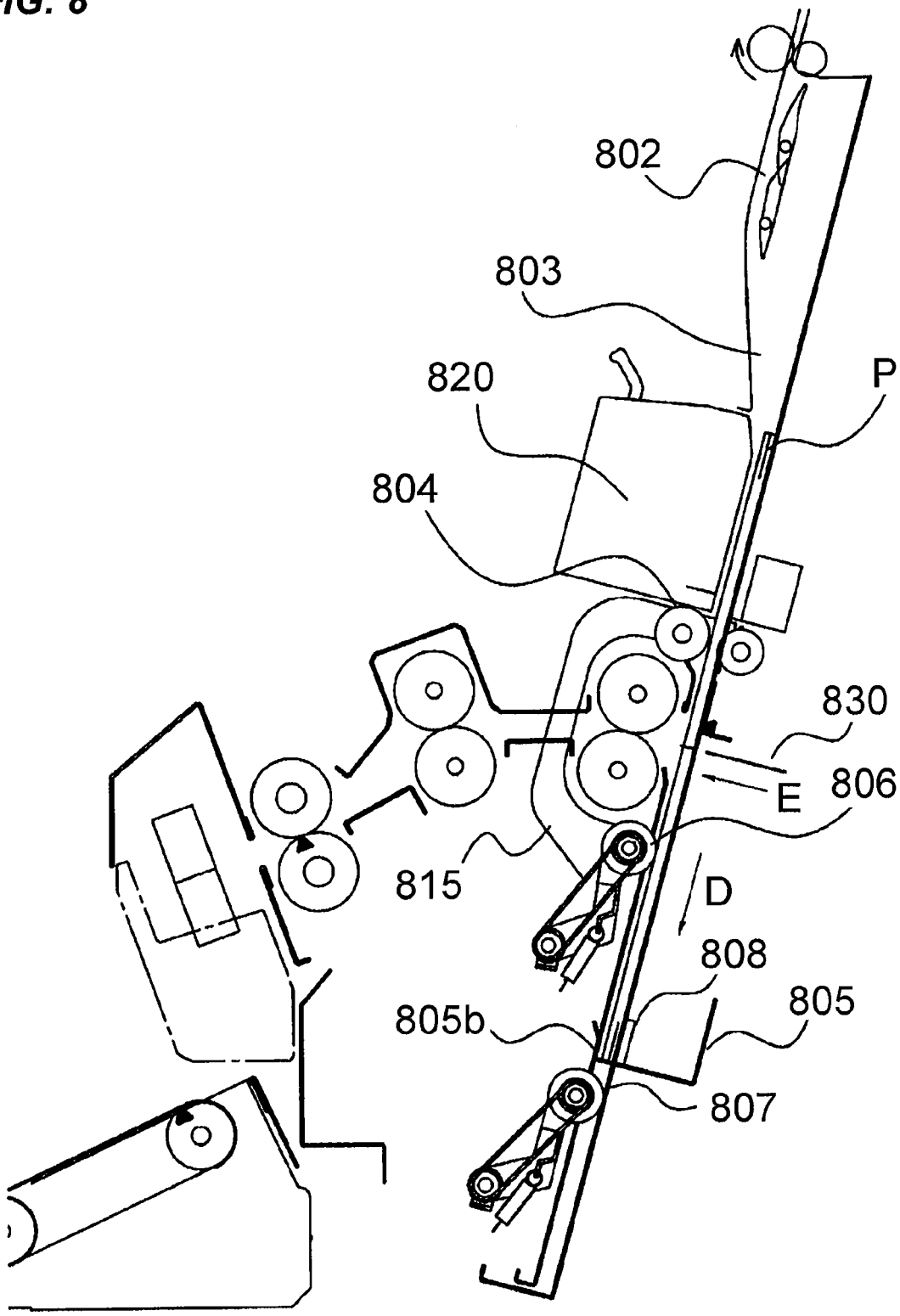
FIG. 8 is a cross-sectional view illustrating the operation of the saddle stitching portion.

The sheet bundle moved to the stapling position as the binding position is stapled by the stapler 820 (step S107). As illustrated in FIG. 8, the stapled sheet bundle P1 held by the holding member 808 is moved downward (in the arrow D direction) together with movement of the end stopper 805. The end stopper 805 is stopped to move in the folding position where the center portion (or stapling portion) of the sheet bundle P1 corresponds to the nip between the pair of folding rollers 810 (steps S108 and S109). The holding member 808 of the end stopper 805 releases the nipped sheet bundle P1 (see FIG. 9).

Figure 9:
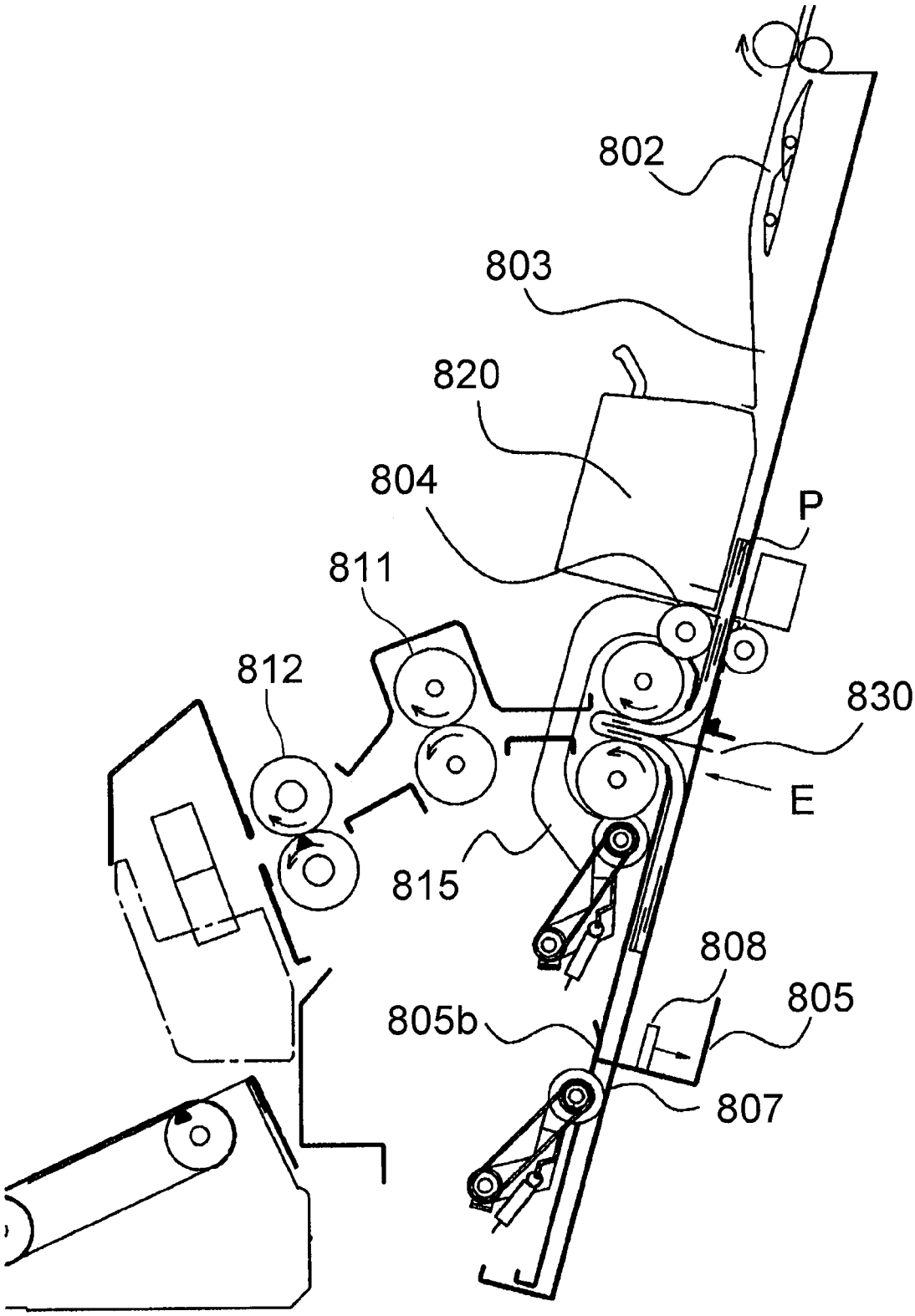
FIG. 9 is a cross-sectional view illustrating the operation of the saddle stitching portion.

As illustrated in FIG. 9, the pushout member 830 in the standby position is started to move in the arrow E direction toward the folding position corresponding to the nip between the pair of folding rollers 810. The sheet bundle P1 is moved while the center portion in the conveying direction is pushed into the pair of folding rollers 810. The sheet bundle P1 is inserted into the nip between the pair of folding rollers 810 and is then folded (step S110). The pair of folding rollers 810 are rotated in the arrow direction together with the pair of first fold conveying rollers 811 and the pair of second fold conveying rollers 812 upon reception of the driving of the motor M4.

Figure 10:
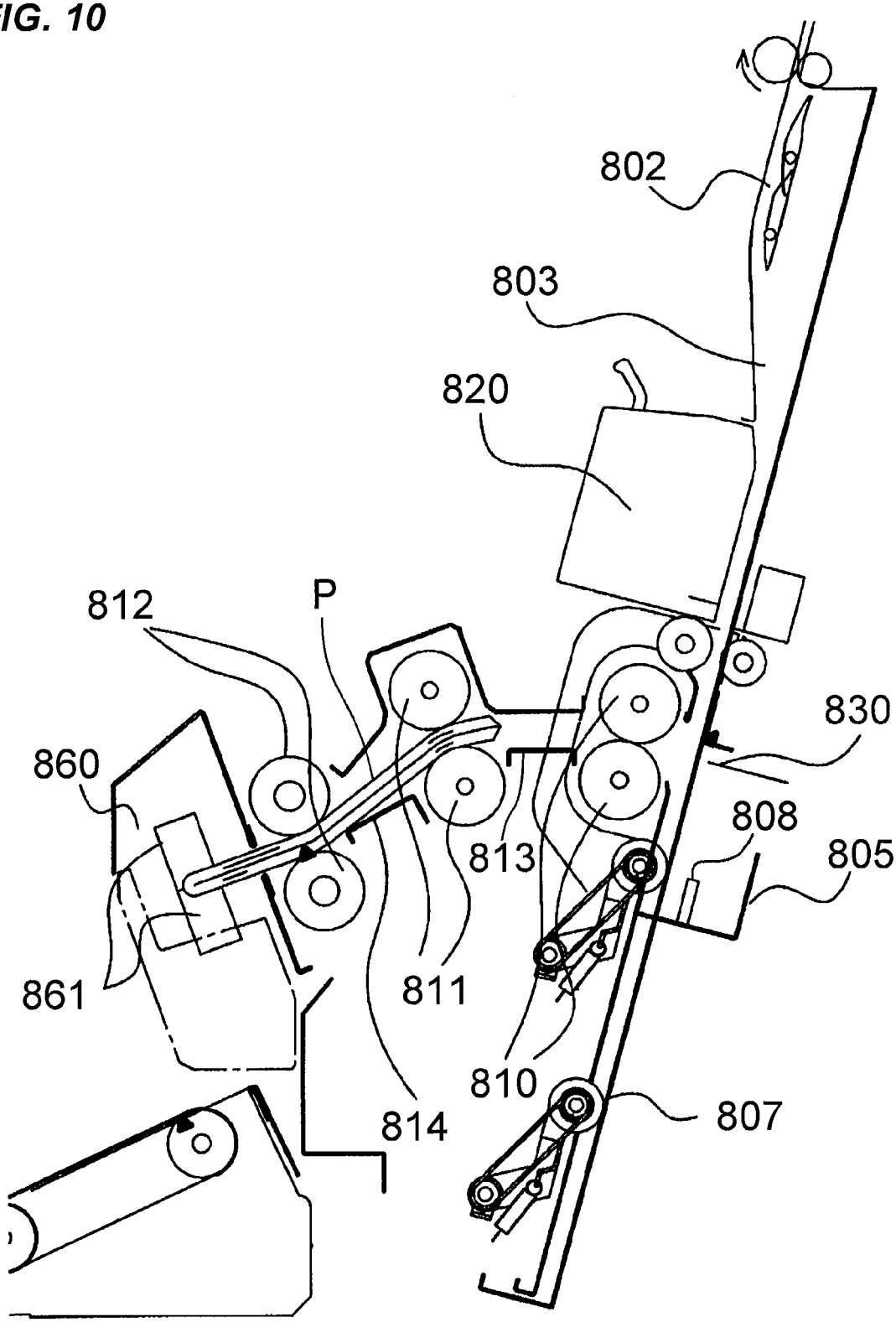
FIG. 10 is a cross-sectional view illustrating the operation of the saddle stitching portion.

As illustrated in FIG. 10, the sheet bundle (or the folded book bundle) P folded by the pair of folding rollers 810 is conveyed in the conveying guides 813 and 814 by the pair of first fold conveying rollers 811 and the pair of second fold conveying rollers 812 by setting the fold at the head. The folded book bundle P is conveyed to the position where the fold is nipped by the pair of press rollers 861 and is then stopped by the motor M4. The sheet bundle is folded by the fold press unit (step S111). The fold press unit 860 which is on standby on one side in the width direction (or the back side of the apparatus) is started to move toward the other side in the width direction (or the front side of the apparatus) along the fold of the sheet bundle. The fold of the sheet bundle is pressed by the pair of press rollers 861.

The fold press unit 860 which completes the folding process moves to the standby position again. The folded book bundle P stopped by the motor M4 is started to be conveyed again and is then discharged toward the folded bundle discharge tray 850 by the pair of second fold conveying rollers 812 (step S112). The discharged folded book bundle P is stacked onto the folded bundle discharge tray 850 located therebelow. The end stopper 805 which has moved for the folding operation for the next sheet is moved to the receiving position again.

The above operation is repeated until a desired number of bundles are discharged onto the folded bundle discharge tray 850 (step S113) to end the job. FIG. 11 illustrates the state that two center folded book bundles P1 and P2 are stacked onto the folded bundle discharge tray 850.

As described above, the receiving position of the end stopper 805 is selected according to the length in the conveying direction of the sheet. Time required for processing the sheet cannot be increased. Regardless of the length in the conveying direction of the sheet, the buckling of the sheet conveyed by the conveying roller and abutted on the end stopper can be prevented.

In the above embodiment, the end stopper receives the sheet on the downstream of each of the two conveying rollers by the distance in the predetermined range. The present invention is not limited to this. Three conveying rollers are provided in the conveying direction. The sheet is received on the downstream of each of the conveying rollers by the distance in the predetermined range. The same effect can be obtained.

In the above embodiment, the processing portion which processes the sheet stored in the storing portion in the predetermined processing position has the stapler (binding portion) 820 and the folding portion having the pair of folding rollers 810 and the pushout member 830. The processing portion may have only the folding portion. Both the binding portion and the folding portion as the processing portion perform saddle stitching which binds the center portion in the conveying direction of the sheet in the predetermined binding position or folding which folds the center portion in the predetermined folding position. The present invention is not limited to this. The processing position of the sheet for the predetermined binding position of the binding portion or the predetermined folding position of the folding portion is not limited to the center portion in the conveying direction of the sheet and may be appropriately set as needed. The length from the processing position of the sheet to the end of the sheet is not limited to the length of half of the conveying direction of the sheet. In the above embodiment, the binding position of the binding portion and the folding position of the folding portion are different in the conveying direction of the sheet, and may be the same processing position. In this case, time required for processing the sheet can be shortened.

In the above embodiment, the sheet processing apparatus which can be installed in the image forming apparatus body as needed is illustrated. The present invention is not limited to this. The sheet processing apparatus may be integral with the image forming apparatus. The present invention is applied to the sheet processing apparatus. The same effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-290521, filed Nov. 8, 2007, and No. 2008-269327, filed Oct. 20, 2008, which are hereby incorporated by reference herein in their entirety.

What is claimed is:

1. A sheet processing apparatus comprising:

a storing portion which stores a conveyed sheet, the storing portion being inclined to be lower on a downstream portion than on an upstream portion in a conveying direction of the sheet;

a processing portion which processes a bundle of a plurality of the sheets stored in the storing portion in a processing position;

a first conveying member which is provided downstream of the processing portion in the conveying direction of the sheet and conveys the sheet conveyed to the storing portion downstream in the conveying direction;

a second conveying member which is provided downstream of the first conveying member in the conveying direction and conveys the sheet conveyed to the storing portion downstream in the conveying direction; and a receiving member which can be moved along the conveying direction of the sheet so that the receiving member receives the downstream end, in the conveying direction, of the sheet conveyed by the first conveying member in a first receiving position downstream of the first conveying member in the conveying direction or the downstream end in the conveying direction of the sheet conveyed by the second conveying member in a second receiving position on the downstream of the second conveying member in the conveying direction, wherein the receiving member has a holding member which nips a sheet bundle and functions as a bundle conveying portion by moving in the conveying direction of the sheet in a state that the sheet bundle is nipped by the holding member.

2. The sheet processing apparatus according to claim 1, wherein one of the first receiving position and the second receiving position, of which a length from the processing position to the respective receiving position is closer to a length between a position to be processed on the sheet and an end to be received of the sheet, is selected as the receiving position of the receiving member.

3. The sheet processing apparatus according to claim 1, wherein when the length from the position to be processed on the sheet to the downstream end in the conveying direction of the sheet is shorter than the length from the processing position to the first receiving position, the first receiving position is selected as the receiving position of the receiving member, and when the length from the processing position on the sheet to the downstream end in the conveying direction of the sheet is longer than the length from the processing position to the first receiving position, one of the first receiving position and the second receiving position, of which a length from the processing position to the respective receiving position is closer to the length between the position to be processed on the sheet and the end to be received of the sheet, is selected as the receiving position of the receiving member.

4. The sheet processing apparatus according to claim 1, wherein a distance between the first conveying member and the first receiving position and a distance between the second conveying member and the second receiving position are set in a predetermined range according to a length of the sheet to be conveyed.

5. The sheet processing apparatus according to claim 1, wherein the processing portion includes a binding portion which binds a bundle of the plurality of sheets stored in the storing portion in a predetermined binding position or a folding portion which folds the sheet bundle in a predetermined folding position.

6. The sheet processing apparatus according to claim 1, wherein when the receiving member receives the downstream end in the conveying direction of the sheet conveyed by the second conveying member in the second receiving position, the first conveying member is moved in the position away from the sheet.

7. An image forming apparatus comprising:

an image forming portion which forms an image on a sheet; and a sheet processing apparatus which processes the sheet having the image formed thereon, the sheet processing apparatus comprising:

a storing portion which temporarily stores a conveyed sheet, the storing portion being inclined to be lower on a downstream portion than on an upstream portion in a conveying direction of the sheet;

a processing portion which processes a bundle of a plurality of the sheets stored in the storing portion in a processing position;

a first conveying member which is provided downstream of the processing portion in the conveying direction of the sheet and conveys the sheet conveyed to the storing portion downstream in the conveying direction;

a second conveying member which is provided downstream of the first conveying member in the conveying direction and conveys the sheet conveyed to the storing portion downstream in the conveying direction; and a receiving member which can be moved along the conveying direction of the sheet so that the receiving member receives the downstream end, in the conveying direction, of the sheet conveyed by the first conveying member in a first receiving position downstream of the first conveying member in the conveying direction or the downstream end in the conveying direction of the sheet conveyed by the second conveying member in a second receiving position downstream of the second conveying member in the conveying direction, wherein the receiving member has a holding member which nips a sheet bundle and functions as a bundle conveying portion by moving in the conveying direction of the sheet in a state that the sheet bundle is nipped by the holding member.

8. The image forming apparatus according to claim 7, wherein one of the first receiving position and the second receiving position, of which a length from the processing position to the respective receiving position is closer to a length between a position to be processed on the sheet and an end to be received of the sheet, is selected as the receiving position of the receiving member.

9. The image forming apparatus according to claim 7, wherein when the length from the position to be processed on the sheet to the downstream end in the conveying direction of the sheet is shorter than the length from the processing position to the first receiving position, the first receiving position is selected as the receiving position of the receiving member, and when the length from the processing position on the sheet to the downstream end in the conveying direction of the sheet is longer than the length from the processing position to the first receiving position, one of the first receiving position and the second receiving position, of which a length from the processing position to the respective receiving position is closer to the length between the position to be processed on the sheet and the end to be received of the sheet, is selected as the receiving position of the receiving member.

10. The image forming apparatus according to claim 7, wherein a distance between the first conveying member and the first receiving position and a distance between the second conveying member and the second receiving position are set in a predetermined range according to a length of the sheet to be conveyed.

11. The image forming apparatus according to claim 7, wherein the processing portion includes a binding portion which binds a bundle of the plurality of sheets stored in the storing portion in a predetermined binding position or a folding portion which folds the sheet bundle in a predetermined folding position.

12. The image forming apparatus according to claim 7, wherein when the receiving member receives the downstream end in the conveying direction of the sheet conveyed by the second conveying member in the second receiving position, the first conveying member is moved in the position away from the sheet.

* * * * *